US009715961B2

(12) United States Patent
Takagi et al.

(10) Patent No.: US 9,715,961 B2
(45) Date of Patent: Jul. 25, 2017

(54) PULSE TRANSFORMER

(71) Applicant: TDK CORPORATION, Minato-ku, Tokyo (JP)

(72) Inventors: Nobuo Takagi, Tokyo (JP); Toshio Tomonari, Tokyo (JP); Setu Tsuchida, Tsuruoka (JP); Syun Ashizawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 14/947,953

(22) Filed: Nov. 20, 2015

(65) Prior Publication Data

US 2016/0155561 A1 Jun. 2, 2016

(30) Foreign Application Priority Data

Dec. 2, 2014 (JP) ..... 2014-244205
Nov. 16, 2015 (JP) ..... 2015-224305

(51) Int. Cl.
*H01F 27/02* (2006.01)
*H01F 27/28* (2006.01)
*H01F 27/29* (2006.01)
*H01F 17/04* (2006.01)

(52) U.S. Cl.
CPC ..... *H01F 27/2823* (2013.01); *H01F 17/045* (2013.01)

(58) Field of Classification Search
CPC ..... H01F 27/292; H01F 5/04; H01F 17/0013; H01F 5/02
USPC ..... 336/83, 187–189, 192, 220–222
See application file for complete search history.

(56) References Cited

U.S. PATENT DOCUMENTS 3,348,182 A * 10/1967 Baker ..... H01F 27/2871 336/187
5,032,808 A * 7/1991 Reddy ..... H03H 7/0115 333/181
7,256,673 B2 * 8/2007 Okumura ..... H01F 17/045 336/192

(Continued)

FOREIGN PATENT DOCUMENTS

CN 103474201 A 12/2013
JP 07106138 A * 4/1995

(Continued)

OTHER PUBLICATIONS

Chinese Office Action of related Chinese Patent Application No. 201510870858.8 dated Mar. 3, 2017.

*Primary Examiner* — Tsz Chan
(74) *Attorney, Agent, or Firm* — Arent Fox LLP

(57) ABSTRACT

A pulse transformer includes a winding drum and a coil portion in which wires are wound around the winding core. The coil portion includes a first general winding area, a second general winding area, and a low density winding area. In the first general winding area, the wires are mutually closely wound around the winding core. In the second general winding area, the wires continuing from the wires of the first general winding area are mutually closely wound around the winding core. The low density winding area is formed along a winding axis of the winding core between the first general winding area and the second general winding area and has a low winding density of the wires along the winding axis.

12 Claims, 11 Drawing Sheets

(56) References Cited

U.S. PATENT DOCUMENTS

2010/0109827 A1* 5/2010 Asou ..... H01F 17/045
336/192
2015/0162126 A1* 6/2015 Kanbe ..... H01F 27/2823
336/192

FOREIGN PATENT DOCUMENTS

JP 2004146683 A * 5/2004
JP 2009-021558 A 1/2009

* cited by examiner

PULSE TRANSFORMER

BACKGROUND OF THE INVENTION

1. Field of the Invention

The present invention relates to a pulse transformer used for transmission of pulse signals through LAN cables or so, for example.

2. Description of the Related Art

When a device such as a personal computer is connected to a network such as a LAN and a telephone network, it is necessary to protect the device from the entry of Electrostatic Discharge (ESD) and high voltage via a cable. Thus, a pulse transformer is used in a connector that constitutes a connection point between the cable and the device.

Pulse transformers conventionally used are manufactured by winding a primary coil and a secondary coil around a donut magnetic core (toroidal core), and have a property of transmitting only an AC component (pulse) of voltage applied to the primary coil to the secondary coil. Since a DC component is not transmitted to the secondary coil, the pulse transformers are able to interrupt ESD and high voltage.

Instead of the toroidal cores, drum cores have been used due to demand for miniaturization and surface mount of the pulse transformers. Such a pulse transformer is referred to as a surface-mount pulse transformer, and Patent Document 1 discloses an example thereof.

By the way, Ethernet communication speed of networks has become popular from 10 Mbps (bit per second) of 10BASE-T to 100 Mbps of 100BASE-TX, which is 10 times faster than 10BASE-T, and 1 Gbps of 1000BASE-T is currently popular. Also, 10GBASE-T (10 gigabits Ethernet (10 GbE)) is newly standardized.

Thus, pulse transformers having a small insertion loss especially at high frequency are demanded. When an insertion loss is small, a signal attenuation amount is small. When an attenuation amount of a component of high frequency is small, high-speed data signals can be accurately transmitted to the long distance. However, it is difficult for the conventional pulse transformers to reduce insertion loss at high frequency especially with severe standards.

Patent Document 1: Japanese Patent Application Laid-open No. 2009-21558

SUMMARY OF THE INVENTION

The present invention has been achieved in consideration of the circumstances, and its object is to provide a pulse transformer enabling to reduce insertion loss at high frequency especially with severe standards.

The present inventors have keenly studied pulse transformers. Then, they have newly found that insertion loss can be reduced by providing a low density winding area in between general coil winding areas in which wires are mutually closely wound around a winding core and making the low density winding area have a winding density lower than that of the general coil winding areas. As a result, they have succeeded in completing the present invention.

That is, a pulse transformer according to the present invention comprises a winding core and a coil portion in which wires are wound around the winding core, wherein the coil portion comprises:

a first general winding area in which the wires are mutually closely wound around the winding core;

a second general winding area in which the wires continuing from the wires of the first general winding area are mutually closely wound around the winding core; and a low density winding area formed along a winding axis of the winding core between the first general winding area and the second general winding area and having a low winding density of the wires along the winding axis.

In the pulse transformer of the present invention, the reason why insertion loss in a high frequency region can be reduced is not necessarily apparent. However, it is conceivable that the reason is due to a reduction in leakage magnetic flux caused by the fact that the winding of the wires becomes disentangled (for example, a wire located in a second layer falls to a first layer) in a boundary between the low density winding area and the general winding area, for example.

In the pulse transformer of the present invention, insertion loss in a high frequency region can be reduced, which allows a reduction in signal attenuation amount at high frequency and an accurate long-distance transmission of high-speed data signals.

Preferably, a surface of the winding core is exposed in the low density winding area. Such a structure can increase a reducing effect of insertion loss in a high frequency region.

Preferably, a gap width in a winding axis direction in which the surface of the winding core is exposed is equal to or larger than a wire diameter of the wire. Such a structure can increase a reducing effect of insertion loss in a high frequency region.

Preferably, a length in a winding axis direction of the low density winding area is equal to twice or larger than a wire diameter of the wire. Such a structure can increase a reducing effect of insertion loss in a high frequency region.

Preferably, a first layer of the coil portion is comprised of a part of a plurality of the wires and a second layer of the coil portion is comprised of a part of the remaining wires. Such a structure can increase a reducing effect of insertion loss in a high frequency region.

Preferably, the wire of the first layer and the wire of the second layer are wound in opposite directions. Such a structure can increase a reducing effect of insertion loss in a high frequency region.

Preferably, a length in a winding axis direction of the first general winding area and a length in a winding axis direction of the second general winding area are respectively equal to a length in which the wires are wound for two or more turns.

The coil portion may further comprise a third general winding area in which the wires continuing from the wires of the second general winding area are mutually closely wound around the winding core and a low density winding area similar to the low density winding area may be formed along a winding axis direction between the third general winding area and the second general winding area.

Preferably, a length in the winding axis direction of the third general winding area is equal to a length in which the wires are wound for two or more turns.

Note that, the coil portion may further have a fourth general winding area, and may further have a low density winding area similar to the low density winding area along the winding axis direction between the fourth general winding area and the third general winding area. Hereinafter, a fifth or more general winding area may be similarly formed together with the low density winding area.

DESCRIPTION OF THE PREFERRED EMBODIMENTS

Figure 1:
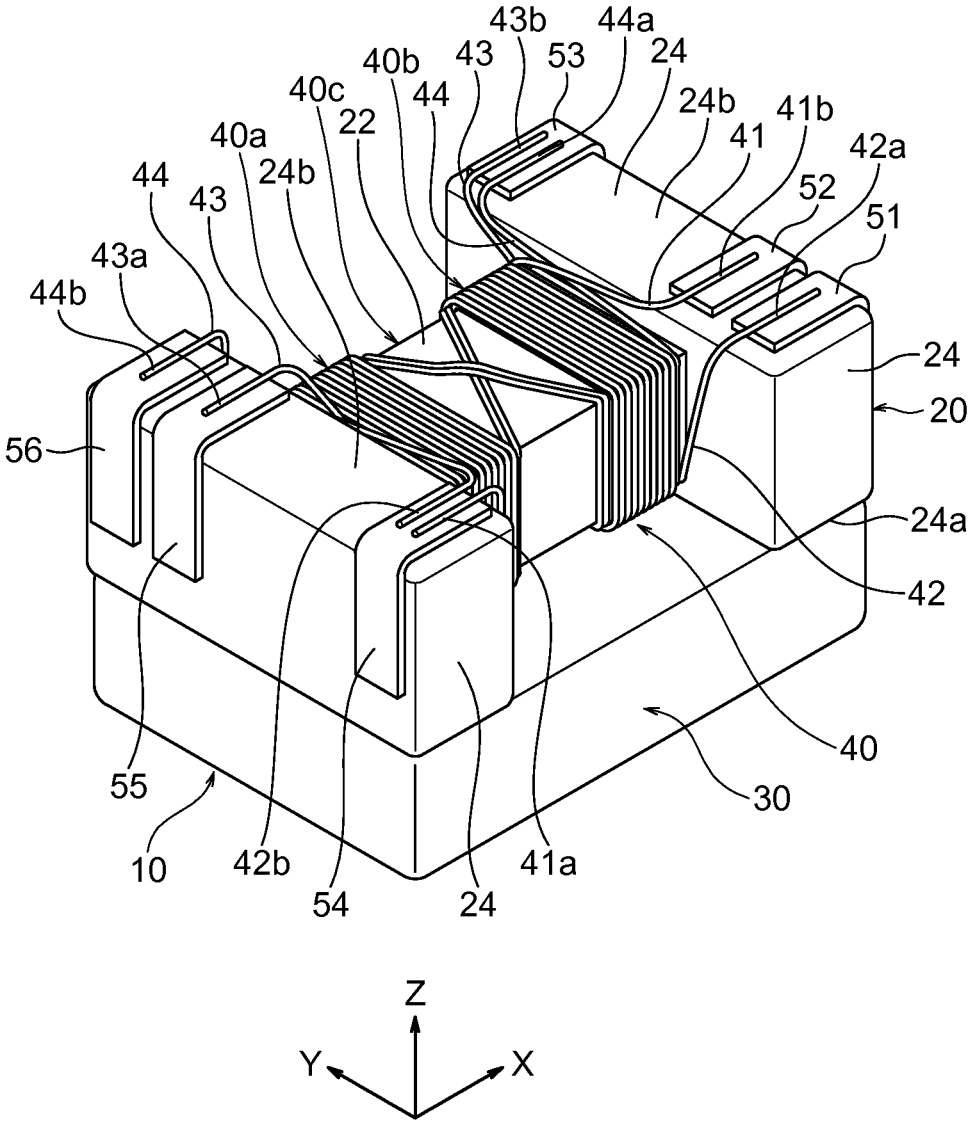
FIG. 1 is a perspective view of a pulse transformer according to one embodiment of the present invention.

Hereinafter, the present invention will be described with reference to embodiments shown in the drawings.

First Embodiment

As shown in FIG. 1, a pulse transformer according to one embodiment of the present invention consists of a surface-mount coil component 10. The coil component 10 includes a first core 20 of a drum core, a plate second core 30, and a coil portion 40 wound around a winding core 22 of the first core 20.

In the description of the coil component 10, please note the following: the X-axis is a direction that is within a surface parallel to a mounting surface on which the coil component 10 is mounted and is parallel to the winding axis of the winding core 22 of the first core 20; the Y-axis is a direction that is within a surface parallel to the mounting surface similarly to the X-axis; and the Z-axis is a normal direction of the mounting surface.

The coil component 10 has an outside dimension of 3.2 mm in width×2.8 mm in height×3.2 mm in length, for example, but is not limited to have this size.

Figure 2A:
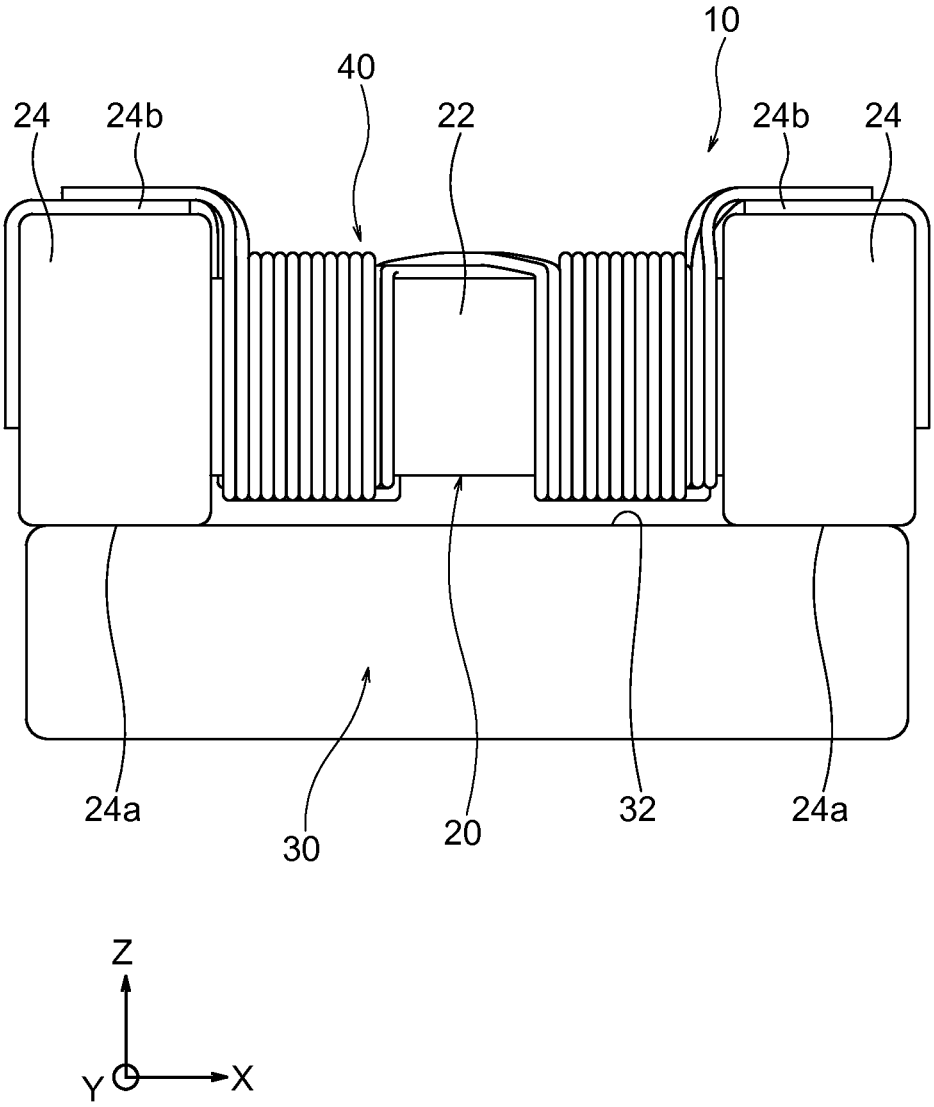
FIG. 2A is a front view of the pulse transformer shown in FIG. 1.
Figure 2B:
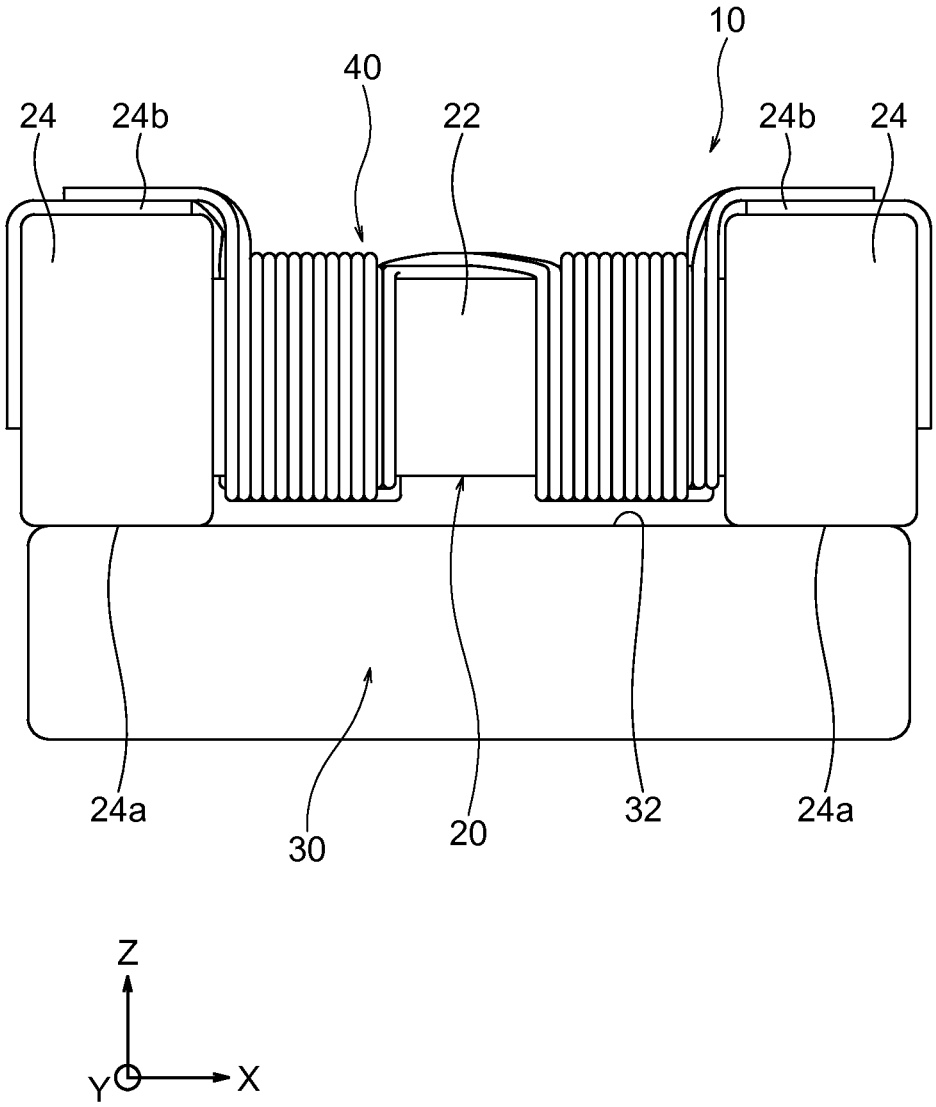
FIG. 2B is a back view of the pulse transformer shown in FIG. 1.
Figure 2C:
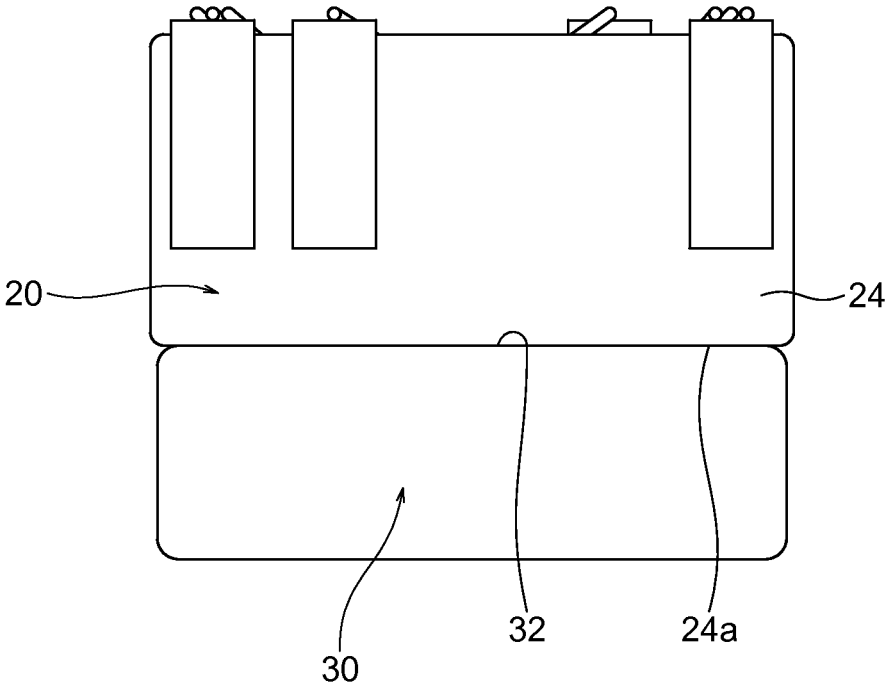
FIG. 2C is a side view of the pulse transformer shown in FIG. 1.

As shown in FIG. 2A of a front view of the coil component 10, a core of the coil component 10 consists of combination of the first core 20 and the second core 30. The first core 20 has the bar-shaped winding core 22 and a pair of flanges 24 and 24 as a pair of core ends provided at both ends of the winding core 22.

As shown in FIG. 1 and FIG. 2A, the flanges 24 have an outer shape of a substantially rectangular parallelepiped shape, and a pair of the flanges 24 is arranged to be substantially parallel to each other with a predetermined distance in the X-axis direction. The winding core 22 is connected to central areas of respective surfaces facing each other of a pair of the flanges 24, which connects a pair of the flanges 24. In this embodiment, the winding core 22 has a cross section of rectangle, but the cross section may be circular and is not limited.

The second core 30 is a plate core and has an outer shape of a substantially rectangular parallelepiped whose shortest sides are along the Z-axis direction. As shown in FIG. 2E, the second core 30 has a shape of a substantial rectangle whose longer sides are along X-axis direction when viewed from a normal direction of a top surface 32 (the Z-axis direction), but may be square or other shapes. As shown in FIG. 2A, both ends in the X-axis direction of a top surface 32 of the second core 30 face bottom surfaces 24*a* of the flanges 24 and are fixed on the bottom surfaces 24*a* by adhesive such as thermosetting resin, for example. This allows the second core 30 to form a magnetic path continuing to the first core 20.

As shown in FIG. 1 to FIG. 2E, terminal parts 51 to 56 are provided with each flange 24 of the first core 20. The terminal parts 51 to 56 consist of fittings having a substantially L-shaped outer shape, and at least a part of each of the terminal parts 51 to 56 is attached on mounting surfaces 24*b* of the flanges 24. Note that, the mounting surfaces 24*b* of the flanges 24 are top surfaces in the Z-axis direction located on the other side of the bottom surfaces 24*a* facing the top surface 32 of the second core 30.

Figure 2D:
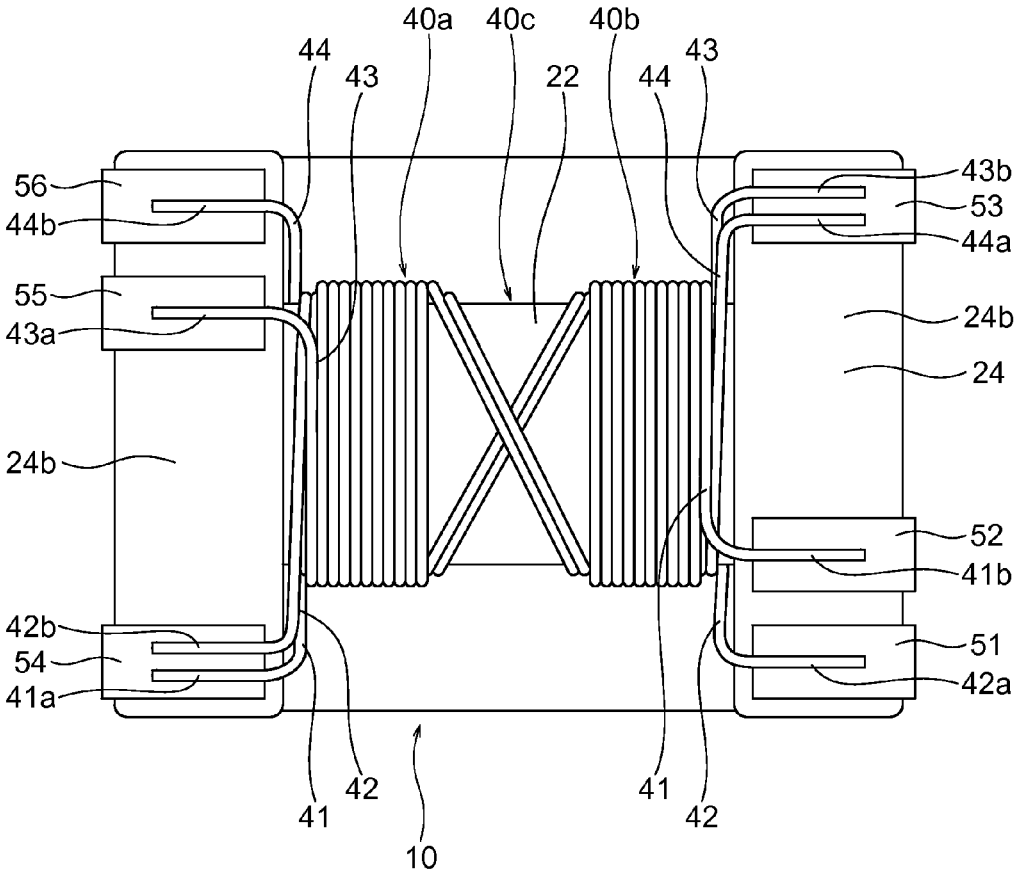
FIG. 2D is a plane view of the pulse transformer shown in FIG. 1.
Figure 2E:
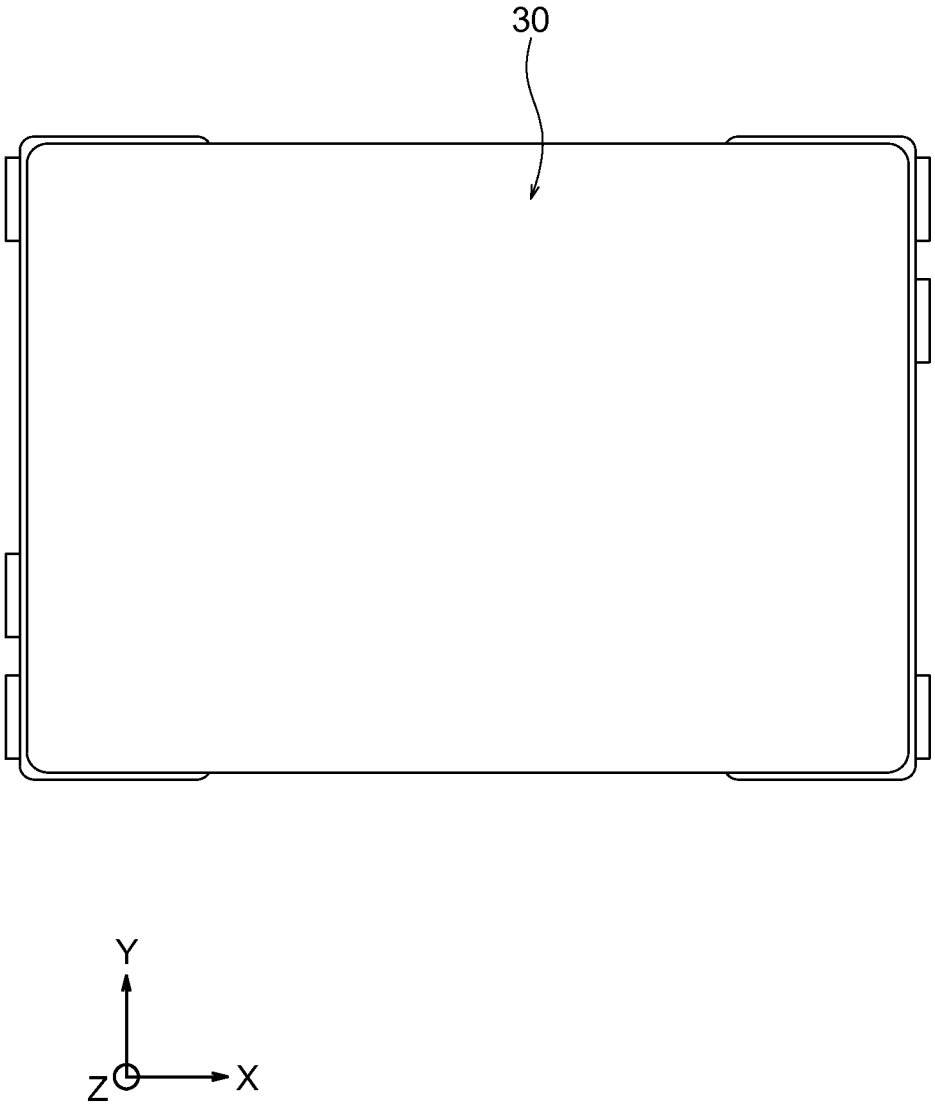
FIG. 2E is a bottom view of the pulse transformer shown in FIG. 1.

As shown in FIG. 2D, indicating the coil component 10 viewed from the above of the Z-axis, the three terminal parts 51 to 53 are attached on one of the flanges 24, and the other three terminal parts 54 to 56 are attached on the other flange 24. Intervals of adjacent terminal parts are not regular. That is, an interval between the terminal part 52 and the terminal part 53 is configured to be wider than an interval between the terminal par 51 and the terminal part 52, and an interval between the terminal part 54 and the terminal part 55 is configured to be wider than an interval between the terminal part 55 and the terminal part 56.

Figure 4:
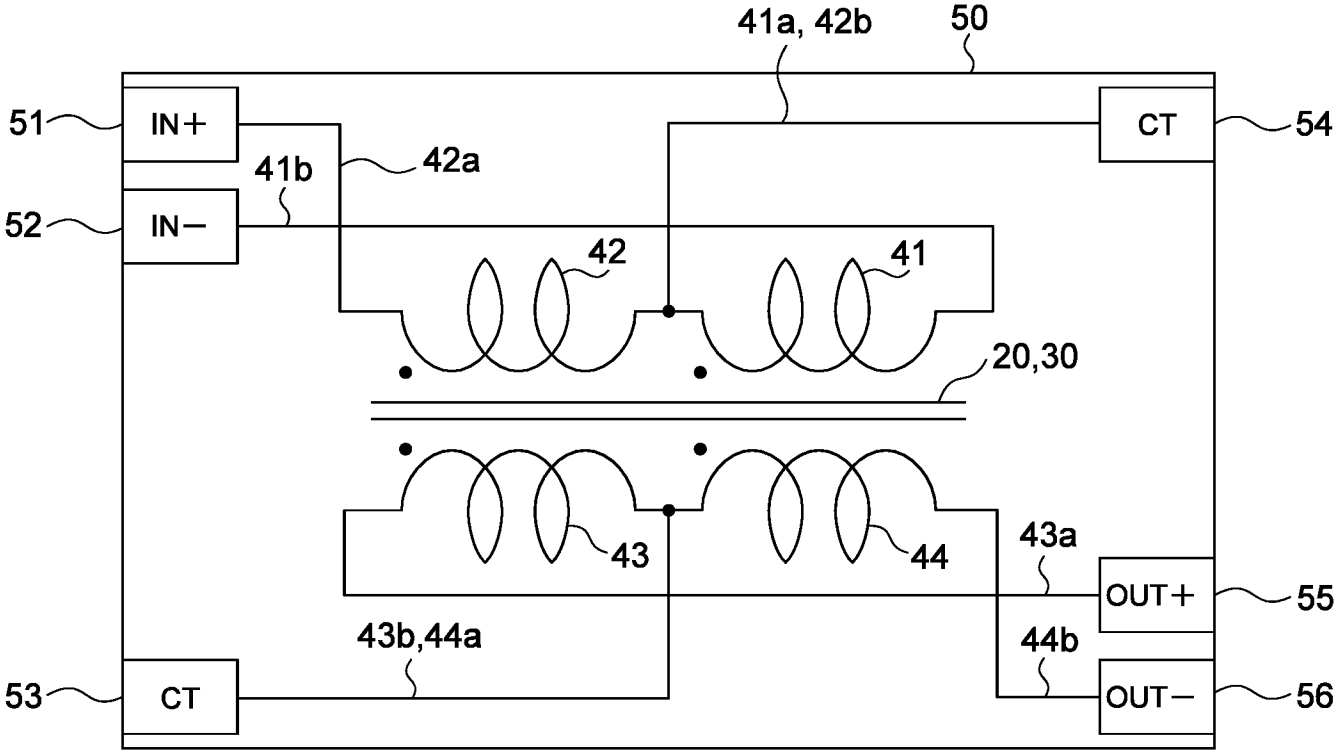
FIG. 4 is an equivalent circuit diagram of the transformer shown in FIG. 1.

As shown in FIG. 2A, the coil portion 40 is formed on the winding core 22 of the first core 20. As shown in FIG. 2D and FIG. 4 of an equivalent circuit diagram, the coil portion 40 consists of four wires 41 to 44. For example, each of the wires 41 to 44 has a core material of a good conductor coated with an insulating film to form a coated wire, and the wires 41 to 44 are wound around the winding core 22 in a two-layer structure.

Figure 3:
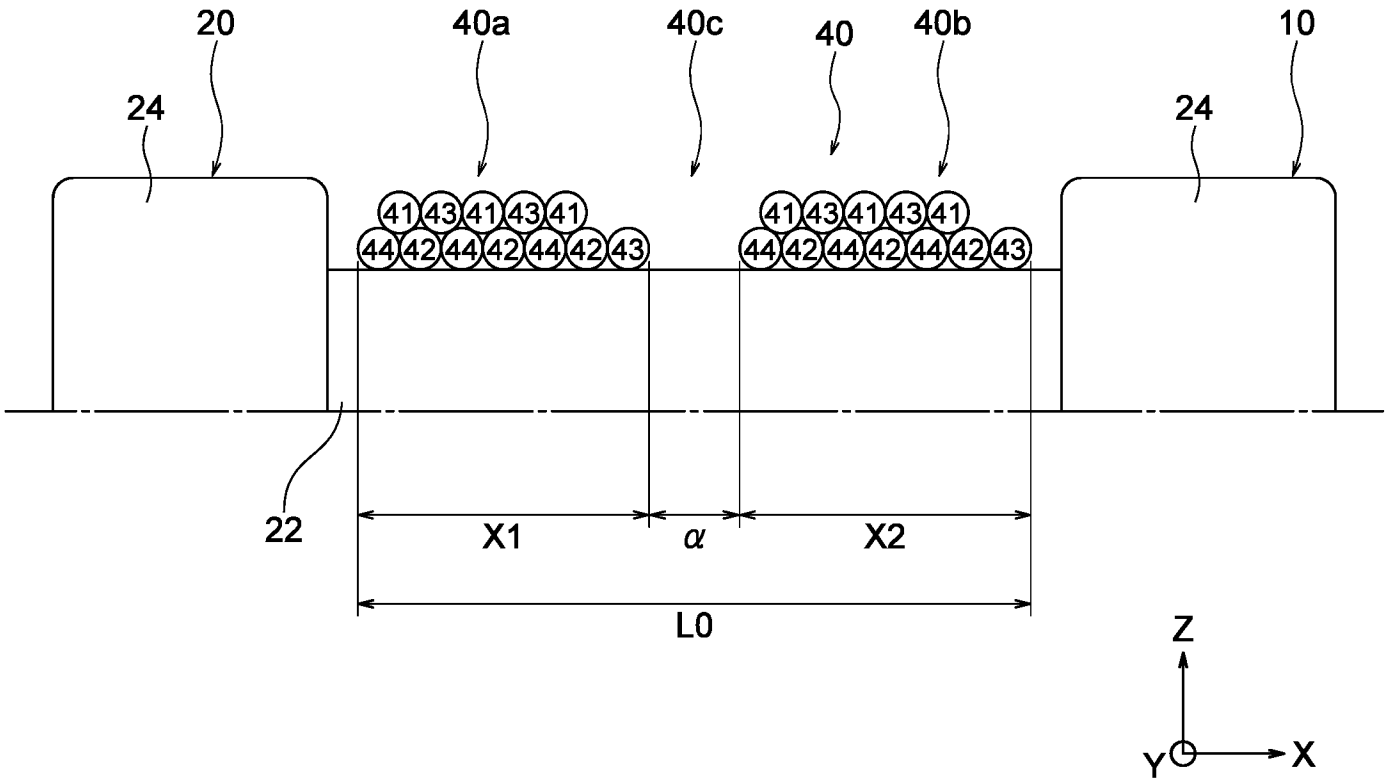
FIG. 3 is a schematic half cross sectional view of a coil portion wound around a winding core of the transformer shown in FIG. 1.

As shown in FIG. 3, the wires 42 and 44 are wound around the wire core 22 by a general bifilar winding to form a first layer, and the wires 41 and 43 are wound around the wire core 22 by a general bifilar winding to form a second layer. Further, in this embodiment, the wires 42 and 44 of the first layer and the wires 41 and 43 of the second layer are wound in opposite directions. Also, all of the winding numbers of the wires 41 to 44 are the same or may be different.

In this embodiment, as shown in FIG. 3, the coil portion 40 includes a first general winding area 40*a*, a second general winding area 40*b*, and a low density winding area 40*c*. The first general winding area 40*a* is an area in which the four wires 41 to 44 are mutually closely wound around the winding core 22. The second general winding area 40*b* is an area in which the wires 41 to 44 continuing from the four wires 41 to 44 of the first general winding area 40*a* are mutually closely wound around the winding core 22.

The low density winding area 40*c* is an area formed along the winding axis (the X-axis) of the winding core 22 between the first general winding area 40*a* and the second general winding area 40*b* and having a low winding density of the wires 41 to 44 along the X-axis. Note that, the low density winding area 40*c* consists of the wires 41 to 44 continuing from the four wires 41 to 44 of the first general winding area 40*a*, and has a winding density of the wires 41 to 44 lower than that in the first general winding area 40*a* and the second general winding area 40*b*.

As shown in FIG. 1, a surface of the winding core 22 is exposed in the low density winding area 40*c*. On the other hand, a surface of the winding core 22 is not exposed to the outside in the first general winding area 40*a* and the second general winding area 40*b* because the both areas are covered with the wires 41 to 44.

As shown in FIG. 3, a length "α" in the winding axis (the X-axis) direction of the low density winding area 40*c* corresponds to the widest gap width in the winding axis direction in which the surface of the winding core 22 is exposed, and is at least equal to or larger than a wire diameter of the wires 41 to 44. In this embodiment, all of the wire diameters of the wires 41 to 44 are the same, but may be different in some cases. When using wires having different wire diameters as the wires 41 to 44, the gap width (length "α") is equal to or larger than the smallest wire diameter.

It is preferred to satisfy a relation of "$d \times n \times T \leq \alpha < L0$" when "α" is a length of the winding axis direction in the low density winding area, "L0" is a length in the winding axis direction of the coil portion 40 (total length), "d" is a wire diameter of the respective wires 41 to 44, "n" is the number of the wires 41 to 44 wound in each layer ("n=2" in this embodiment), and "T" is a minimum winding number (an integer of 1 or more). The total length "L0" of the coil portion 40 is equal to or less than a total length in the Z-axis direction of the winding core 22.

A length in the winding axis direction of one of the first general winding area 40*a* and the second general winding area 40*b* that is shorter than that of the other winding area is a length where the four wires 41 to 44 are wound for two or more turns in two or more layers. That is, when "X1" is a length in the X-axis direction of the first general winding area 40*a* and "X2" is a length in the X-axis direction of the second general winding area 40*b*, the length "X1" and the length "X2" are respectively a length where the wires 41 to 44 are wound for two or more turns in two or more layers. In this embodiment, a relation of "$L0=X1+\alpha+X2$" is satisfied. Also, "X1/X2" preferably satisfies 0.5 to 2, and more preferably satisfies around 1.

The winding of the four wires 41 to 44 may become disentangled in a boundary between the first general winding area 40*a* and the low density area 40*c*, a boundary between the second general winding area 40*b* and the low density area 40*c*, or at least one end in the X-axis direction of the coil portion 40, and at least one of the wires 41 and 43 located in the second layer may fall to the first layer, for example. As shown an example of FIG. 3, the wire 43 located in the second layer falls to the first layer in the boundary between the first general winding area 40*a* and the low density area 40*c*. Also, the wire 43 located in the second layer falls to the first layer at an end of the coil portion 40 in the second general winding area 40*b*.

In this embodiment, the first general winding area 40*a* and the second general winding area 40*b* consist of a series of the same four wires 41 to 44, and a pair of the wires 42 and 44 in the first layer and a pair of the wires 41 and 43 in the second layer are wound in opposite directions. Thus, as shown in FIG. 1, a portion in which a pair of the wires 42 and 44 in the first layer and a pair of the wires 41 and 43 in the second layer are crossed is formed at least at one place (preferably at one place) in the low density winding area 40*c*.

As shown in FIG. 1, FIG. 2D and FIG. 4, wire ends 41*a* and 41*b* of the wire 41 are respectively connected to the terminal parts 54 and 52, wire ends 42*a* and 42*b* of the wire 42 are respectively connected to the terminal parts 51 and 54, and wire ends 43*a* and 43*b* of the wire 43 are respectively connected to the terminal parts 55 and 53. Also, wire ends 44*a* and 44*b* of the wire 44 are respectively connected to the terminal ends 53 and 56.

Note that, as shown in FIG. 4, the terminal parts 51 and 52 are respectively used as a positive-side terminal IN+ and a negative-side terminal IN− of balanced inputs. Also, the terminal parts 55 and 56 are respectively used as a positive-side terminal OUT+ and a negative-side terminal OUT− of balanced outputs. The terminal parts 53 and 54 are respectively used an input-side intermediate tap CT and an output-side inter mediate tap CT. The wires 41 and 42 constitute a primary winding of the pulse transformer, and the wires 43 and 44 constitute a secondary winding of the pulse transformer.

When manufacturing the coil component 10, the drum first core 20 on which the terminal parts 51 to 56 are placed and the wires 41 to 44 are firstly prepared. The first core 20 is formed of molding and sintering a magnetic material having a relatively high permeability, such as Ni—Zn ferrite and Mn—Zn ferrite, or a magnetic powder composed of a metal magnetic substance or so, for example. The metal terminal parts 51 to 56 are attached on the flanges 24 of the first core 20 by adhesion or so. Note that, the terminal parts 51 to 56 may be placed on the flanges 24 by forming a conductive film on the first core 20 with such as printing and plating and firing the conductive film.

The wires 41 to 44 can be obtained by covering a core material made of a good conductor such as copper (Cu) with an insulating material made of imide-modified polyurethane or so, and further covering its outermost surface with a thin resin film such as polyester, for example. The first core 20 on which the terminal parts 51 to 56 prepared are mounted and the wires 41 to 44 are positioned in a winding machine, and the wires 41 to 44 are wound around the winding core 22 of the first core 20 in a predetermined order. The wire ends 41*a* to 44*a* and 41*b* to 44*b* of the wires 41 to 44 wound are attached to the predetermined terminal parts 51 to 56 shown in FIG. 2D and FIG. 4 by silver soldering, thermo-compression, laser joining, or the like.

Next, the plate second core 30 is prepared and joined to the first core 20 wound by the coil portion 40. Similarly to the first core 20, the second core 30 is formed of a sintering body or a molding body of a magnetic material made of Ni—Zn ferrite, Mn—Zn ferrite, a metal magnetic body, or the like.

In the pulse transformer 10 according to the present embodiment, insertion loss can be reduced especially at high frequency with severe standards. The reason why insertion loss in a high frequency region can be reduced is not necessarily apparent. However, it is conceivable that the reason is due to a reduction in leakage magnetic flux caused by the fact that, as shown in FIG. 3, the winding of the four wires 41 to 44 becomes disentangled, and the wire 43 located in the second layer falls to the first layer and is located adjacent to the wire 42 in the boundary between the low density winding area 40*c* and the first general winding area 40*a*.

In the pulse transformer 10 of this embodiment, insertion loss in a high frequency region can be reduced, which allows a reduction in signal attenuation amount at high frequency and an accurate long-distance transmission of high-speed data signals.

Second Embodiment

Figure 5:
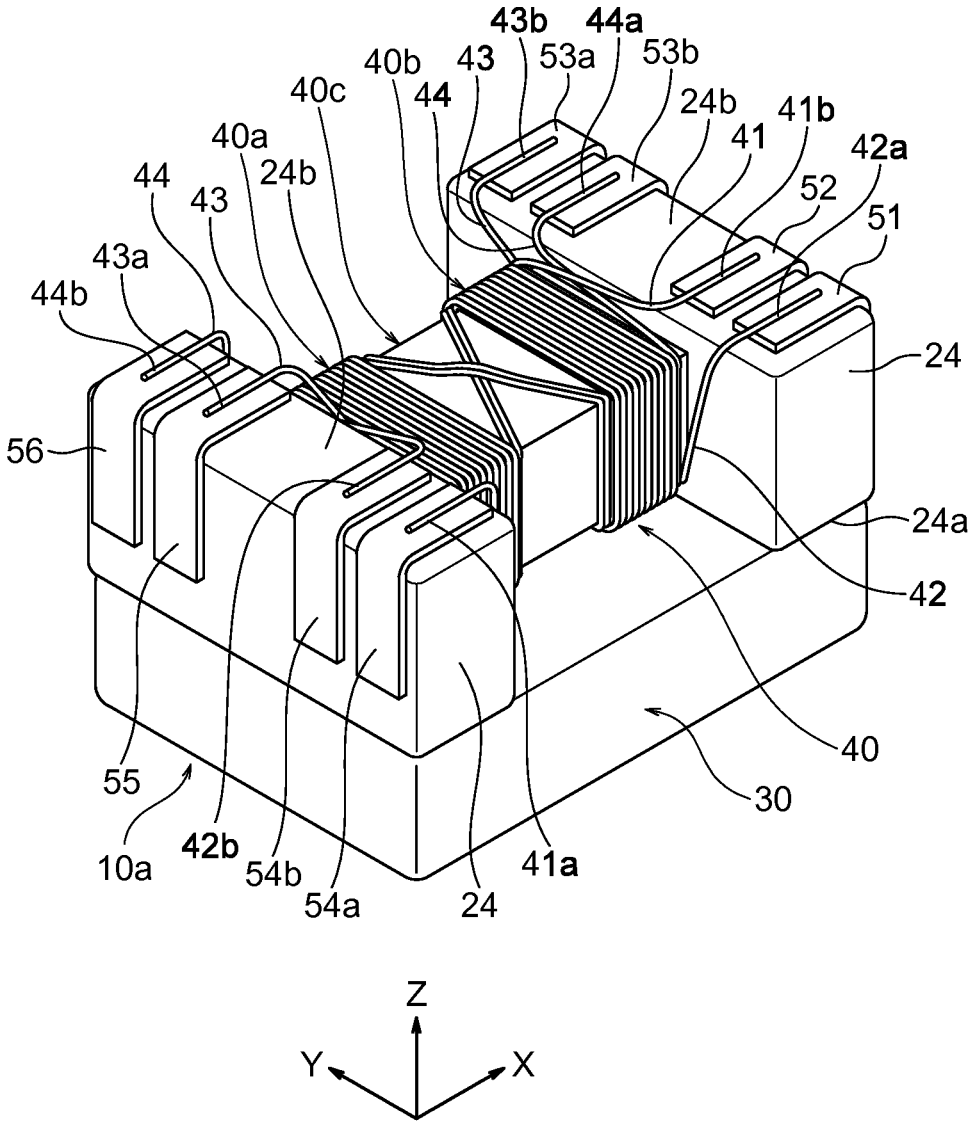
FIG. 5 is a perspective view of a pulse transformer according to another embodiment of the present invention.

A coil component 10*a* as a pulse transformer of the second embodiment shown in FIG. 5 is different from a coil component 10 of the first embodiment in that four terminal parts are placed on both sides of flanges 24 (i.e., eight terminal parts in total), but the other features are the same as those of the first embodiment. Terminal parts 53*a* and 53*b* of the coil component 10*a* correspond to a terminal part 53 of the coil component 10 of the first embodiment, and terminal parts 54*a* and 54*b* of the coil component 10*a* correspond to a terminal part 54 of the coil component 10.

In the coil component 10*a*, an electrical connection between a wire end 43*b* and a wire end 44*a* and an electrical connection between a wire end 41*a* and a wire end 42*b* are carried out through a wiring pattern on a wiring board on which the coil component 10*a* is mounted. The other features and effects of the coil component 10*a* according to this embodiment are the same as those of the first embodiment, and detailed description thereof is omitted.

Third Embodiment

Figure 7:
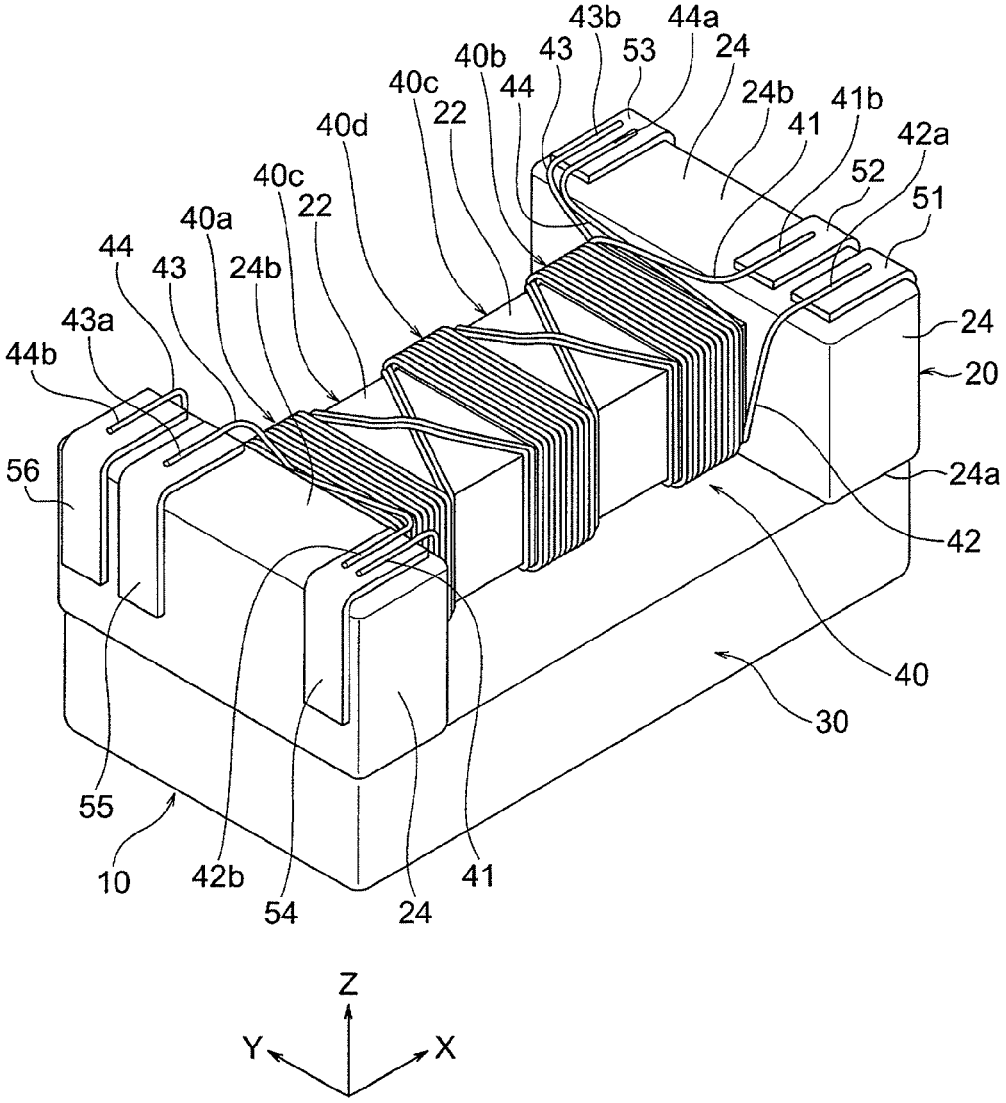
FIG. 7 is a perspective view of a pulse transformer according to another embodiment of the present invention.

In this embodiment, as shown in FIG. 7, a coil portion 40 shown in FIG. 1 and FIG. 5 may further have a third general winding area, and may have a low density winding area similar to a low density winding area 40*c* along the Z-axis direction between the third general winding area and a second general winding area 40*a*.

Note that, the coil portion 40 may further have a fourth general winding area, and may further have a low density winding area similar to the low density winding area along the winding axis direction between the fourth general winding area and the first general winding area, or between the fourth general winding area and the third general winding area. Hereinafter, a fifth or more general winding area may be similarly formed together with the low density winding area 40*c*. The third or more general winding area has the same constitution as the first general winding area 40*a* or the second general winding area 40*b*. The other features and effects of the coil component 10*a* according to this embodiment are the same as those of the first embodiment, and detailed description thereof is omitted.

Note that, the present invention is not limited to the embodiments mentioned above and can be changed variously within the scope thereof.

For example, the first core 20 is not limited to have a drum shape shown in the embodiments, but may have any shape including a pair of core ends at both ends of the winding core, such as U-shaped. Two flanges 24 of the first core 20 may have the same or different shape.

In the above-mentioned embodiments, the first layer of the coil portion 40 consists of the two wires 42 and 44, and the second layer thereof consists of the other two wires 41 and 43, but the wire 41 and the wire 42 may consist of a continuous one wire turned back at the terminal part 54. Also, the wire 43 and the wire 44 may consist of a continuous one wire turned back at the terminal part 53.

Further, the terminal parts 53 and 54 are used in the above-mentioned embodiments, but may be omitted depending on usage. That is, the terminal parts 53 and 54 used as an input-side intermediate tap CT and an output-side intermediate tap CT, as shown in FIG. 4, may be removed, and a pulse transformer may be employed. In this case, the pulse transformer is employed using only two wires.

Further, in the present invention, the number of wires used during winding may be reduced by devising a winding method of wire for the winding core 22. For example, with one or two wires, a first layer of the coil portion 40 may be formed at the winding core 22, a second layer of the core portion 40 may be formed using the same wire, and a boundary between a primary winding and a secondary winding at the coil portion may be cut to separate them.

In the above-mentioned embodiments, as shown in FIG. 1, an intersection portion where a pair of the wires 42 and 44 in the first layer and a pair of the wires 41 and 43 in the second layer are crossed is formed on the top surface of the winding core 22 in the Z-axis direction, but this is not restrictive. For example, the intersection portion may be formed on the bottom surface of the winding core 22 in the Z-axis direction, or may be formed on side surfaces of the winding core 22 opposing to the Y-axis direction.

EXAMPLES

Hereinafter, the present invention will be further described based on examples, but is not limited thereto.

Example 1

As shown in FIG. 1 to FIG. 3, a pulse transformer was manufactured with a coil component 10 satisfying a relation of "$L0=X1+\alpha+X2$". In this relation, "$\alpha$" was a space of a wire diameter of two or more wires, and "X1" was approximately equal to "X2". The result of insertion loss of the pulse transformer is shown by a curve of "ex1" in FIG. 6. Note that, in FIG. 6, the horizontal axis represents a measuring frequency shown by exponent index and having a unit of MHz, and the vertical axis represents an insertion loss showing a signal attenuation characteristic and having a unit of dB. The insertion loss was measured by a network analyzer.

Example 2

A pulse transformer consisting of a coil component was manufactured in the same way as Example 1, except for the following: a third general winding area whose length in the Z-axis direction was "X3" (not shown) was formed adjacent to a second general winding area 40*b* of a coil portion 40 shown in FIG. 3 together with another low density area whose length in the Z-axis direction was "$\alpha$" (not shown); there was a relation of "$L0=X1+\alpha+X2+\alpha+X3$"; and each of "X1", "X2" and "X3" was approximately equal. The result of insertion loss of the pulse transformer measured in the same way as Example 1 is shown by a curve of "ex2" in FIG. 6.

Example 3

A pulse transformer consisting of a coil component was manufactured in the same way as Example 2, except for the following: a fourth general winding area whose length in the Z-axis direction was "X4" (not shown) was formed adjacent to a third general winding area together with another low density area whose length in the Z-axis direction was "$\alpha$" (not shown); there was a relation of "$L0=X1+\alpha+X2+\alpha+X3+\alpha+X4$"; and each of "X1", "X2", "X3" and "X4" was approximately equal. The result of insertion loss of the pulse transformer measured in the same way as Example 1 is shown by a curve of "ex3" in FIG. 6.

Comparative Example 1

A pulse transformer consisting of a coil component was manufactured in the same way as Example 1, except that a coil portion was formed by winding wires 41 to 44 with the same winding number as Example 1 without forming a low density area 40*c* as shown in FIG. 3. The result of insertion loss of the pulse transformer measured in the same way as Example 1 is shown by a curve of "Ce1" in FIG. 6.

Evaluation

Figure 6:
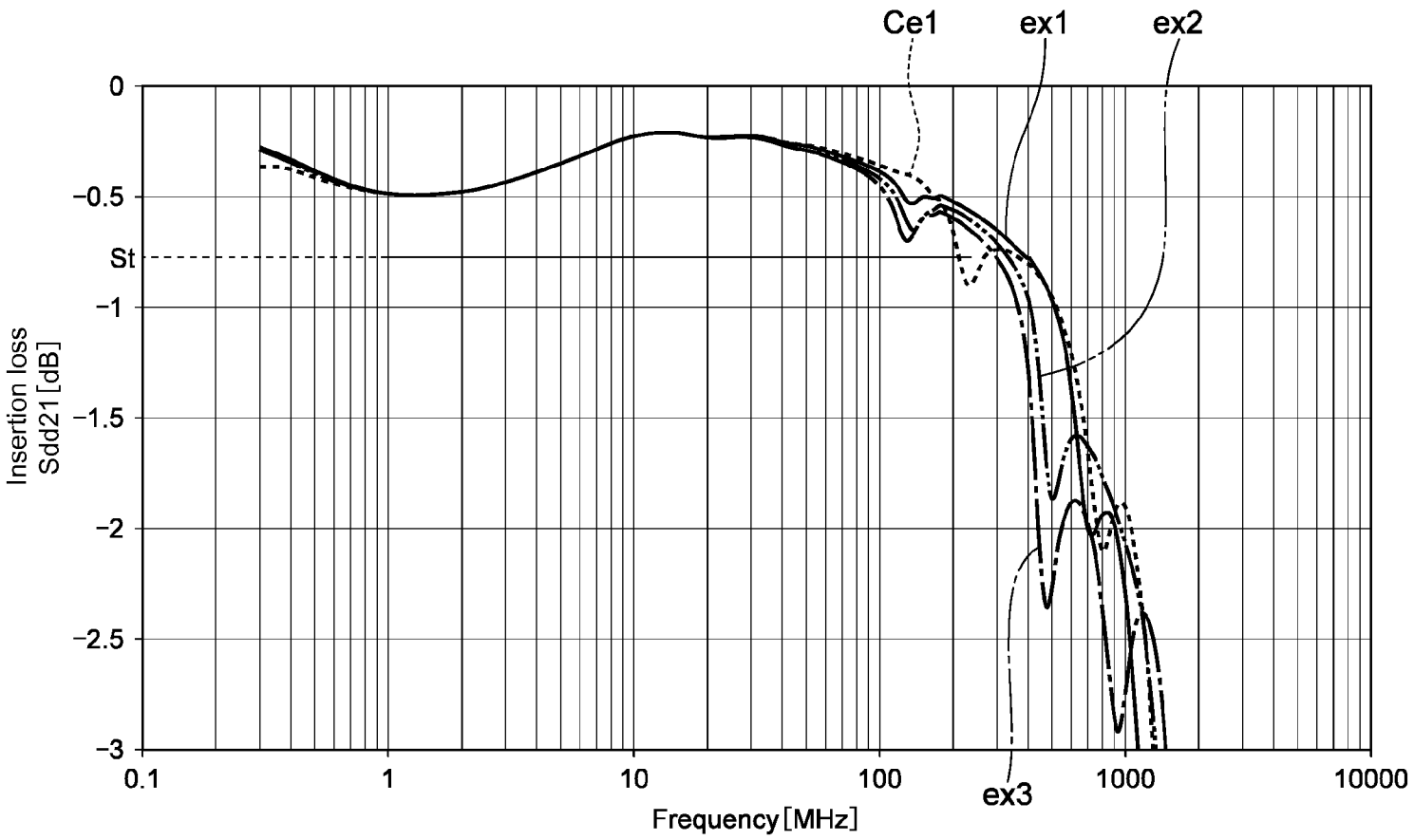
FIG. 6 is a graph showing a reducing effect of insertion loss of a pulse transformer according to Examples of the present invention.

As shown in FIG. 6, it was found for all of the pulse transformers of Examples 1 to 3 ("ex1" to "ex3") to be able to obtain insertion loss that is lower than a standard insertion loss of −0.8 dB especially in a high frequency region of 250 MHz or less, compared to the pulse transformer of Comparative Example 1 (Ce1).

The invention claimed is:

1. A pulse transformer comprising a winding core and a coil portion in which wires are wound around the winding core, wherein the coil portion comprises:

a first general winding area in which the wires are mutually closely wound around the winding core;

a second general winding area in which the wires continuing from the wires of the first general winding area are mutually closely wound around the winding core; and a low density winding area formed along a winding axis of the winding core between the first general winding area and the second general winding area and having a lower winding density of the wires along the winding axis than the first general winding area and the second general winding area, wherein the wires are wound around the winding core in two or more layers and the surface of the winding core is not exposed in the first general winding area and the second general winding area; and wherein a portion in which a pair of the wires in the first layer and a pair of the wires in the second layer are crossed is formed at least at one place in the low density winding area.

2. The pulse transformer as set forth in claim 1, wherein a surface of the winding core is exposed in the low density winding area.

3. The pulse transformer as set forth in claim 2, wherein a gap width in a winding axis direction in which the surface of the winding core is exposed is equal to or larger than a wire diameter of the wire.

4. The pulse transformer as set forth in claim 1, wherein a length in a winding axis direction of the low density winding area is equal to twice or larger than a wire diameter of the wire.

5. The pulse transformer as set forth in claim 2, wherein a length in a winding axis direction of the low density winding area is equal to twice or larger than a wire diameter of the wire.

6. The pulse transformer as set forth in claim 3, wherein a length in a winding axis direction of the low density winding area is equal to twice or larger than the wire diameter of the wire.

7. The pulse transformer as set forth in claim 1, wherein a first layer of the coil portion is comprised of a part of a plurality of the wires and a second layer of the coil portion is comprised of a part of the remaining wires.

8. The pulse transformer as set forth in claim 7, wherein the wire of the first layer and the wire of the second layer are wound in opposite directions.

9. The pulse transformer as set forth in claim 1, wherein a length in a winding axis direction of the first general winding area and a length in a winding axis direction of the second general winding area are respectively equal to a length in which the wires are wound for two or more turns.

10. The pulse transformer as set forth in claim 1, wherein the coil portion further comprises a third general winding area in which the wires continuing from the wires of the second general winding area are mutually closely wound around the winding core and the low density winding area is formed along a winding axis direction between the third general winding area and the second general winding area.

11. The pulse transformer as set forth in claim 10, wherein a length in the winding axis direction of the third general winding area is equal to a length in which the wires are wound for two or more turns.

12. The pulse transformer as set forth in claim 1, wherein a length in a winding axis direction of the low density winding area is shorter than each length in a winding axis direction of the first general winding area and the second general winding area.

* * * * *